United States Patent [19]

Sitler

[11] 4,139,662

[45] Feb. 13, 1979

[54] METHOD OF AND APPARATUS FOR METERING FAST-REACTING SATURANT ONTO SHEET MATERIAL

[75] Inventor: Rickie L. Sitler, Wrightsville, Pa.

[73] Assignee: Armstrong Cork Company, Lancaster, Pa.

[21] Appl. No.: 851,443

[22] Filed: Nov. 14, 1977

[51] Int. Cl.[2] ..... B05C 5/02

[52] U.S. Cl. ..... 427/358; 427/434 R; 118/415

[58] Field of Search ..... 118/412, 415; 68/200; 427/356, 358, 434 R, 445

[56] References Cited

U.S. PATENT DOCUMENTS

| | | | |
|---|---|---|---|
| 428,188 | 5/1890 | Videto | 118/415 X |
| 3,205,089 | 9/1965 | Kinzelman | 118/324 X |
| 3,628,503 | 12/1971 | Neuhaus et al. | 118/415 X |
| 4,016,831 | 4/1977 | James et al. | 118/415 |

*Primary Examiner*—John McIntosh

[57] ABSTRACT

A sheet material to be saturated with a fast-reacting saturant, approximately one minute at room temperature, passes under a trough positioned across the travelling web and having a longitudinal slot through its bottom. A threaded rod having a diameter larger than the slot width is laid over the slot in the trough. The fast-reacting saturant is supplied to a traversing dispensing device located above the trough. This traversing device dispenses the saturant into the trough. The threaded rod co-acts with the slot in the bottom of the trough to meter the amount of fast-reacting saturant flowing through the trough and onto the sheet material moving under and contacting the bottom of the trough.

18 Claims, 3 Drawing Figures

METHOD OF AND APPARATUS FOR METERING FAST-REACTING SATURANT ONTO SHEET MATERIAL

BACKGROUND OF THE INVENTION

1. Field of the Invention

This invention relates to a method of and apparatus for applying a saturant to a moving sheet material and, more particularly, to the method of and apparatus for metering a fast-reacting saturant onto moving sheet material.

2. Description of the Prior Art

U.S. Pat. No. 428,188 teaches a device for the rubber-striping of waterproof fabrics. This device uses a trough having a series of openings through its bottom spaced along the length of the trough. A shallow channel or channels lead transversely from each of these openings. The trough serves as a reservoir for the rubber-striping compound, which passes through the openings and transverse channels leading from these openings to form stripes on the fabric as the fabric moves in surface contact with the bottom of the trough. Although the apparatus of the invention described herein may be considered somewhat similar to the rubber-striping device, there are several important differences. One such difference is that there is only one continuous slot through the bottom of the trough in the invention as opposed to a series of openings in the patented device. Another difference is the absence of transverse channels leading from either longitudinal edge of the slot of the invention. Still another difference is that the metering achieved by the invention described herein is from the co-action of a threaded rod placed over the slot so that it contacts the upper longitudinal edges of the slot through the bottom of the trough. The method of the invention described herein also differs from the teaching of U.S. Pat. No. 428,188 in that it is essential to have no larger reservoir in the trough than can be metered through the slot in the trough and onto the sheet material in less time than it takes for the fast-reacting saturant to set-up or cure. The rubber-striping device teaches the use of a large reservoir of rubber-coating compound in the trough with no concern for applying the rubber compound to the moving fabric before the rubber compound cures.

U.S. Pat. No. 3,110,919 teaches a coater for spreading photo-sensitive material over conventional screen material. The method and apparatus of the invention described herein is concerned with metering a fast-reacting saturant onto moving sheet material. The patent teaches a flexible bar with a series of grooves around its circumference as an alternative to the helically wound spring which is defined as that part of the apparatus which applies the coating of photo-sensitive material to the screen, it being noted that it is the flexibility of the bar which will lead to the application of a substantially uniform coating. The method and apparatus of the invention described herein uses a threaded rod co-acting with the upper longitudinal edges of the slot in the bottom of the trough as a metering device, it being of no particular consequence whether the threaded rod be flexible or rigid. Also, the threaded rod of the invention herein does not contact the moving sheet material being coated as does the flexible bar of the patent when applying a coating to a screen.

U.S. Pat. No. 3,045,273 teaches the use of a threaded elongated member supported from above and positioned against one edge of a lower chamber wall in association with compressed air in the chamber to clean a surface of material moving thereunder, the threads forming a plurality of high velocity ports which produce considerable turbulence of the air emanating therefrom. A vacuum system adjacent the turbulent air producing apparatus assists in cleaning the surface of the material moving thereunder. There are several important differences between the method and apparatus of the invention described herein and the teaching of U.S. Pat. No. 3,045,273. One such difference is that the invention is directed to metering a fast reacting saturant onto moving sheet material and not concerned with cleaning a surface of moving material. Other differences are that the threaded rod of the invention is removably (not fixedly) supported from below (not above) and is in contact with two (not one) edges of a slot. Still another difference is that the invention does not use a vacuum whereas a vacuum is an integral part of the teaching of U.S. Pat. No. 3,045,273.

SUMMARY OF THE INVENTION

A sheet material to be saturated with a fast-reacting saturant having a set-up or cure time of approximately one minute at room temperature is moved under an apparatus for metering the fast-reacting saturant onto the sheet material. The fast-reacting saturant is supplied to a dispensing means. The dispensing means, which is positioned over a trough, traverses the trough and dispenses the saturant while traversing the trough. The trough has an opening in the form of a longitudinal slot through its bottom. A metering means in the form of a rod having a diameter larger than the width of the slot and having a circumferentially grooved surface is positioned in the trough over the opening therein. The co-action of the metering means with at least the upper longitudinal edges of the slot serves to meter the fast-reacting saturant in the trough through the opening in the bottom of the trough onto the sheet material moving under the apparatus since this sheet material is adjacent to at least the longitudinal edges of the opening on the outer surface of the trough as it moves under the apparatus. The amount of fast-reacting saturant dispensed into the trough for metering onto the moving sheet material must be sufficient to saturate the moving sheet material, but no greater than that amount which can be metered through the apparatus in a time less than is required for the material to set-up or cure.

It is an object of the present invention to provide an apparatus for metering a fast-reacting saturant onto moving sheet material.

Another object of this invention is to provide a simple and inexpensive apparatus for metering a fast-reacting saturant onto moving sheet material.

A further object of the present invention is to provide an apparatus for metering a fast-reacting saturant onto moving sheet material wherein the metering means can easily be removed from the apparatus.

Another object of the invention is to provide an apparatus for metering a fast-reacting saturant onto moving sheet material wherein the metering device can easily be changed to alter the rate of metering of the fast-reacting saturant.

A still further object of the present invention is to provide a method of metering a fast-reacting saturant onto moving sheet material.

Yet another object of the present invention is to provide a simple method for metering a fast-reacting saturant onto moving sheet material.

A still further object of this invention is to provide a method of and apparatus for metering a fast-reacting saturant onto moving sheet material to produce uniformly saturated sheet material.

DESCRIPTION OF THE PREFERRED EMBODIMENT

Figure 1:
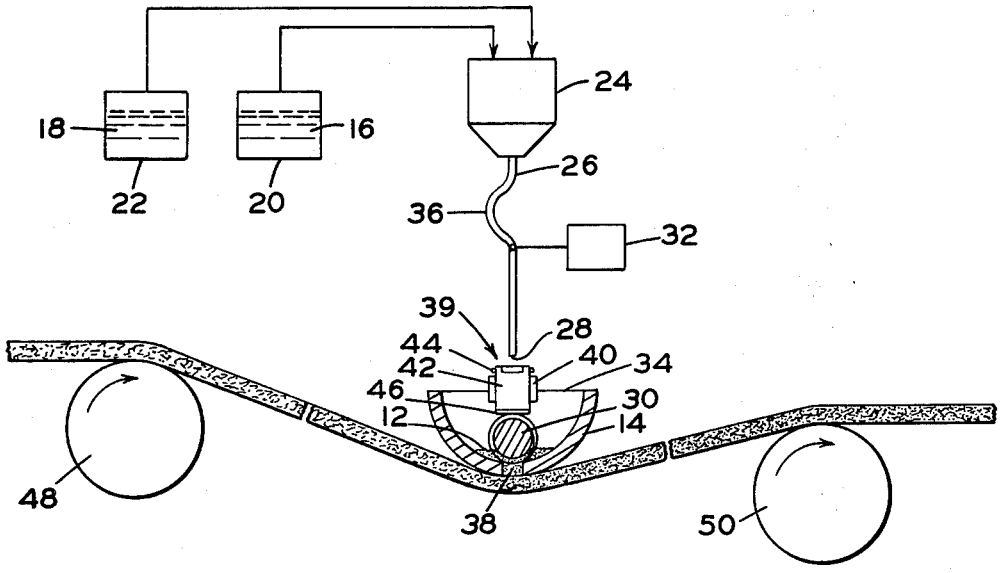
FIG. 1 is a diagrammatic elevational view partially in section of the apparatus for metering a fast-reacting saturant onto moving sheet material.
Figure 2:
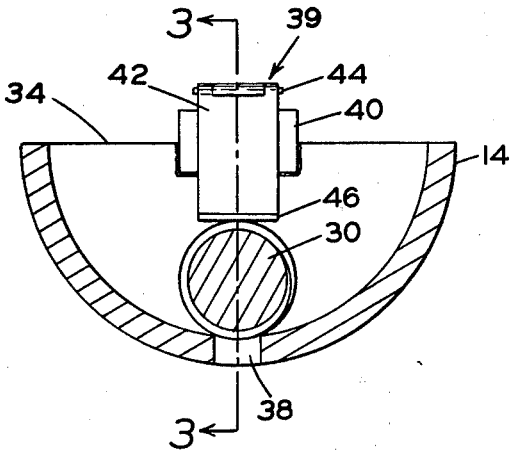
FIG. 2 is an enlarged cross-sectional view in elevation of the trough, metering device, and metering device hold-down means of the apparatus.
Figure 3:
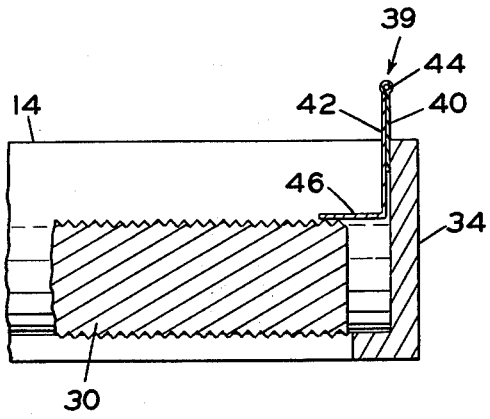
FIG. 3 is a cross-sectional view of FIG. 2 taken along line 3—3 and looking in the direction of the arrows.

A sheet material 10 to be saturated with a fast-reacting saturant 12 passes under trough 14. The sheet material 10 to be saturated may be any conventional and well known sheet materials such as felt, glass fiber paper, spun-bonded polyester fabric, and woven fabrics of jute or cotton and may be of any desired width. In this example, the sheet material 10 is a carrier felt made by needlepunching two polyester webs with an open-glass scrim between them. This felt contains 9 oz./sq. yd. (0.30 kg/m$^2$) of polyester, with the glass scrim bringing the total weight of the felt to approximately 11 oz./sq. yd. (0.37 kg/m$^2$) and has a length of approximately 21" (53.34 cm) and a thickness in the range of approximately 0.120 to 0.140" (0.304 to 0.366 cm).

The fast-reacting saturant 12 in this example is the product of mixing two solutions in an equal unit ratio and is marketed under the trademark Poly-Chem of Poly-Chem Industries, Inc. Solution 16 is a formaldehyde-melamine-urea resin solution having the following formula, with one unit having 50.8% solids:

1.35 mole formaldehyde as 37% aqueous solution
0.10 mole melamine
0.30 mole urea Solution 18 is a urea-titanium tetrachloride solution having the following formula, with one unit having 57.6% solids:

0.05 mole titanium tetrachloride
0.60 mole urea
water to make a total of 79 grams Solutions 16 and 18 are stored in any conventional storage tanks 20 and 22 respectively. Solutions 16 and 18 are each individually fed to a conventional mixing head 24 in any conventional manner, such as by pumps, gravity, or some other conventional means. Although not shown in FIG. 1 and not an essential part of the invention, means for preventing the mixing of solutions 16 and 18 such as valving means in the lines between the storage tanks and mixing head or means for recirculating solutions 16 and 18 back to their individual storage tanks 20 and 22 respectively could be used with this apparatus if it were desired. Any conventional valving or recirculation means known to those skilled in the art could be used for this purpose. Use of the valving or recirculating means would prevent the solutions from being mixed, and therefore, from forming a fast-reacting saturant having a set-up or cure time of approximately 1 minute at ambient temperature, this time being critical since the saturant 12 must be metered onto the sheet material 10 prior to the passing of this time period. Although the Poly-Chem fast-reacting saturant is described above, other fast-reacting, multiple component saturants such as low viscosity urethanes, epoxies, polyesters, phenols, ureas, or melamines can be used in the method and apparatus of this invention.

The mixing head 24 is the mixing head portion of a urethane foam dispensing machine, such as the Lake Erie Machine Co., Model 510 Unifoam, which has an air-driven impeller. Although this mixing head has solenoid controlled valving which could be used in conjunction with a recirculation system, such valving is not an essential part of this invention. In fact, any conventional mixing head known to those skilled in the art which could accommodate the number of components being mixed and provides adequate mixing capability will suffice.

When the solutions 16 and 18 are mixed together in the mixing head 24, they produce the Poly-Chem fast-reacting saturant 12 which has a water-like consistency. From the time that the saturant 12 is produced in mixing head 24 until the saturant is metered onto the sheet material 10, the time that elapses should be no greater than the time that it takes for the fast-reacting saturant to set-up or cure. For this reason, it is important that the amount of saturant being mixed in the mixing head be equal to or only slightly greater than the amount being metered onto the moving sheet material.

As the saturant 12 exits from mixing head 24, it enters dispensing hose 26. This hose 26 has an inside diameter of approximately ¼" (0.64 cm). The opening 28 of dispensing hose 26 is positioned above the threaded rod 30 positioned in trough 14. At some convenient point between the end of hose 26 attached to mixing head 24 and the end of hose 26 having opening 28 therein, the hose is attached to a conventional reciprocating device 32. Any such conventional device which will cause the opening 28 of hose 26 to reciprocate between ends 34 of trough 14 and which is known to those skilled in the art will suffice as the reciprocating device. The loop 36 represents that excess amount of hose 26 which is needed to allow the end of hose 26 having opening 28 therein to reciprocate between the ends 34 of trough 14.

The trough 14 is positioned above and perpendicularly across the sheet material 10 travelling thereunder. The length of trough 14 should preferably be several inches longer than the width of sheet material 10. In this example, with a felted fabric sheet material 21" (53.34 cm) wide, the trough is approximately 24" (60.96 cm) long. In this example, the trough is made of copper and has a cross-section of a semi-cylinder having an inside diameter of approximately 2" (5.08 cm). Troughs having other cross-sections could also be used so long as there is no portion of the trough which would prevent some of the fast-acting saturant from being allowed to exit through the slot 38 through the bottom of trough 14. Also, the trough can be made of any desired material so long as it is resistant to any corrosive action which may be caused by the saturant 10. Slot 38 in the bottom of trough 14 should preferably be the same length as the width of sheet material 10. However, if desired, slot 38 could be slightly shorter, by some small distance, approximately 1" (2.54 cm), than the felted fabric being saturated. In this latter situation, an unsaturated selvage would remain at the edges of the felted fabric and would probably require subsequent trimming from the sheet. In this example, slot 38 is approximately 21" (53.34 cm) long, the width of the fabric being saturated.

The width of slot 38 may range from approximately 1/16" (0.159 cm) to 3/16" (0.476 cm). In this example, slot 38 had a width of approximately ⅛" (0.318 cm).

Threaded rod 30 in this example is made of steel, but could be made of any other material which is resistant to any corrosive action caused by being in contact with fast-reacting saturant 12. Although rod 30 has conventional helical threads thereon, any rod having relatively closely spaced circumferential grooves would also suffice as the metering device 30. The outside diameter of the threaded metering rod 30 may range from about ¼" (0.635 cm) to 7/16" (1.111 cm). In this example, threaded metering rod 30 is approximately ⅜" (0.953 cm). Rod 30 should be only slightly shorter than the length of slot 38, the clearance between the ends of rod 30 and the ends of slot 38 being minimal. In this example, the metering rod is approximately 21" (53.34 cm) long, the approximate length of slot 38 of trough 14.

Threaded metering rod 30 is positioned in slot 38 in the bottom of trough 14. Since rod 30 has a length shorter than the length of slot 38, rod 30 contacts and is supported by the upper longitudinal edges of slot 38.

Although not necessary, it may be desirable to have a hold down means at each end of trough 34 for holding metering rod 30 against the upper longitudinal edges of slot 38 in the bottom of trough 14. Any conventional hold down device known to those skilled in the art can be used for the purpose of holding rod 30 against the bottom of trough 14. In this example, a rigid strip of metal 40 is fixedly attached to each end 34 of trough 14. Strip 40 extends above the top of trough 14 any conveniently desirable length. A second rigid strip of metal 42 is rotatably fastened at its top to the top of strip 40 with any conventional hinge-type device 44. Another rigid strip of metal 46 is fixedly attached perpendicular to the bottom of strip 42 so that strip 46 is in a horizontal plane when strip 42 is in a vertical plane. The distance between the tops of strips 40 and 42 and the top of threaded metering rod 30 when rod 30 is positioned in the bottom of trough 14 should be the length of strip 42. When strips 42 and 46 are rotated into the position shown in FIG. 1, they act as a simple hold down means for the threaded metering rod 30. Since strips 42 and 46 can be rotatably moved out of the position shown in FIG. 1, it is a very simple matter to remove threaded metering rod 30 if it is desired for any reason. A new or cleaned metering rod may be inserted into the bottom of the trough just as easily as a used metering rod can be removed therefrom by simply reversing the removal procedure.

After the saturant 12 moves through dispensing tube 26 and exits from opening 28 therein, the saturant 12 is dispensed into trough 14 by being dispensed onto the top of metering rod 30 as the dispensing tube is traversing the trough. In this example, the traverse of the dispensing tube is approximately equal to the length of slot 38 which is approximately 21" (53.34 cm). The Poly-Chem fast-reacting saturant 12 deposited on the top of threaded metering rod 30 from the dispensing tube longitudinally reciprocating over the trough 14 flows approximately equally to both sides of rod 30. The fast-reacting saturant 12 which has flowed to either side of rod 30 is metered between the upper longitudinal edges of slot 38 and the threaded circumference of metering rod 30.

This metering action between these threads or grooves and upper longitudinal edges tends to break up the stream of material which is dispensed into the trough so that the saturant is uniformly metered through slot 38 onto moving sheet material 10. It is desirable that approximately the same amount of saturant is metered through the slot and onto the moving web of sheet material as is dispensed into the trough. This keeps to a minimum the possibility that the saturant will set-up or cure before it has been metered onto the moving web.

In this example, the sheet material moves over roll 48, under but in contact with at least the lower longitudinal edges of slot 38 of trough 14, and over roll 50. The elevation of rolls 48 and 50 at those points on these rolls at which the sheet material 10 passes over these rolls should be at least the same as the elevation of the lower longitudinal edges of slot 38 of trough 14. This would assure at least a slight upward pressure of the sheet material against the lower longitudinal edges of the slot. Preferably, the elevation of rolls 48 and 50 at those points on these rolls at which the sheet material 10 passes over these rolls should be somewhat higher than the elevation of the lower longitudinal edges of slot 38 of trough 14.

After saturant 12 has been metered onto moving sheet material 10 and the sheet 10 so treated passes over roll 50, it may be desirable to pass the sheet through a pair of squeeze rolls for further uniformly distributing the saturant within the sheet. It may also be desired to thermally treat the saturated sheet to cure the saturant therein. However, neither of these additional steps are essential for the proper functioning of the apparatus and method of the invention herein.

Although it is desired that essentially all of the material dispensed into trough 14 be metered through the slot in the bottom of the trough onto the moving sheet material which is to be saturated with the saturant before the saturant cures or sets-up in the trough, over a period of time there may be some buildup of the saturant possibly in the trough but more probably on the metering rod 30. If such buildup does occur on metering rod 30, whether the simple hold down means 39 is used or no hold down means are used, the metering rod can easily be removed from the trough for cleaning and a replacement metering rod can immediately be positioned in the bottom of the trough with essentially no interruption to the metering of saturant onto the sheet material.

What is claimed is:

1. An apparatus for metering a fast-reacting saturant onto moving sheet material comprising:

(a) a trough having an opening through its bottom, the longitudinal edges of said opening on the outer surface of said trough being adjacent to said moving sheet material, (b) a metering means having a circumferentially grooved surface positioned in said trough over said opening, (c) a means for dispensing a fast-reacting saturant into said trough, (d) a means for supplying said saturant to said dispensing means, and (e) a releasable means for holding down said metering means in said trough over said opening.

2. The apparatus of claim 1 wherein the trough has a cross-sectional shape of a semi-cylinder.

3. The apparatus of claim 1 wherein said opening comprises a slot.

4. The apparatus of claim 3 wherein the length of the slot is less than the interior length of the trough.

5. The apparatus of claim 4 wherein the ends of the slot are each spaced inwardly from the interior ends of the trough.

6. The apparatus of claim 3 wherein the slot has a length equal to about that portion of the width of said sheet material to be saturated.

7. The apparatus of claim 1 wherein the fast-reacting saturant to be metered onto the moving sheet material has a cure time of no less than the time required for said saturant to move from said supply means to said sheet material onto which said saturant is to be metered.

8. The apparatus of claim 1 wherein said metering means having a circumferentially grooved surface has a diameter greater than the width of said opening.

9. The apparatus of claim 8 wherein said metering means has a length about equal to but no greater than the length of said opening.

10. The apparatus of claim 1 wherein said metering means having a circumferentially grooved surface comprises a threaded rod.

11. The apparatus of claim 1 wherein said means for dispensing the fast-reacting saturant into said trough comprises a dispensing tube.

12. The apparatus of claim 11 wherein said dispensing tube is positioned to dispense said saturant onto the top of said metering means.

13. The apparatus of claim 12 wherein said dispensing means reciprocatingly traverses the trough at least the length of said opening.

14. A method of metering a fast-reacting saturant onto moving sheet material comprising the steps of:

(a) providing sheet material to be saturated with a fast-reacting saturant, (b) moving said material under a trough while being adjacent to the lower longitudinal edges of an opening through the bottom of said trough, (c) supplying a fast-reacting saturant to a dispensing device, (d) dispensing said saturant from said dispensing device into said trough, and (e) metering said saturant in said trough by flowing said saturant between a rod having a circumferentially grooved surface and the upper longitudinal edges of the opening through the bottom of said trough and then flowing said saturant through the opening in the bottom of said trough onto the moving sheet material.

15. The method of claim 14 wherein the fast-reacting saturant to be metered onto the moving sheet material has a cure time of no less than the time required for said saturant to move from said supply means to said sheet material onto which said saturant is to be metered.

16. The method of claim 14 wherein the step of moving said material under a trough while being adjacent to the longitudinal edges of an opening through the bottom of said trough comprises the step of moving said material under a trough while contacting at least the longitudinal edges of the opening through the bottom of said trough.

17. The method of claim 14 wherein the step of dispensing said saturant comprises the step of dispensing said saturant onto the top of the device which meters said saturant in said trough through the opening in the bottom of said trough onto the moving sheet material.

18. The method of claim 17 wherein said dispensing step comprises the dispensing of said saturant while reciprocatingly traversing at least the length of the opening through the bottom of said trough.

* * * * *